US009216448B2

(12) United States Patent
Schmeink et al.

(10) Patent No.: US 9,216,448 B2
(45) Date of Patent: Dec. 22, 2015

(54) DRAWING PRESS HAVING TWO COUPLABLE RAMS

(75) Inventors: Martin Schmeink, Salach (DE); Thomas Menzel, Eislingen (DE)

(73) Assignee: Schuler Pressen GMBH, Goppingen (DE)

( * ) Notice: Subject to any disclaimer, the term of this patent is extended or adjusted under 35 U.S.C. 154(b) by 107 days.

(21) Appl. No.: 14/005,049

(22) PCT Filed: Mar. 16, 2012

(86) PCT No.: PCT/EP2012/054716

§ 371 (c)(1), (2), (4) Date: Oct. 14, 2013

(87) PCT Pub. No.: WO2012/123583

PCT Pub. Date: Sep. 20, 2012

(65) Prior Publication Data

US 2014/0047892 A1 Feb. 20, 2014

(30) Foreign Application Priority Data

Mar. 16, 2011 (DE) ..... 10 2011 001 314

(51) Int. Cl.

| | |
|---|---|
| ***B21D 22/22*** | (2006.01) |
| ***B21D 22/20*** | (2006.01) |
| ***B21D 22/24*** | (2006.01) |
| ***B21D 24/12*** | (2006.01) |
| ***B30B 1/14*** | (2006.01) |
| ***B30B 15/12*** | (2006.01) |

(52) U.S. Cl.

CPC ..... *B21D 22/20* (2013.01); *B21D 22/22* (2013.01); *B21D 22/24* (2013.01); *B21D 24/12* (2013.01); *B30B 1/14* (2013.01); *B30B 15/12* (2013.01)

(58) Field of Classification Search

CPC ..... B21D 22/20; B21D 22/22; B21D 22/24; B21D 24/10; B21D 24/12; B21D 24/04; B21D 24/08; B21D 24/14; B30B 1/14; B30B 15/12; B30B 15/14; B30B 15/142

USPC ..... 72/347, 350, 353.2, 306, 450, 451, 72/312–316, 322, 323, 417

See application file for complete search history.

(56) References Cited

U.S. PATENT DOCUMENTS

| | | | | |
|---|---|---|---|---|
| 4,996,864 | A * | 3/1991 | Enami | 72/347 |
| 5,626,048 | A * | 5/1997 | McClung | 72/336 |
| 6,505,492 | B2 * | 1/2003 | Jroski | 72/348 |
| 6,626,022 | B1 * | 9/2003 | Stamm | 72/450 |
| 2008/0028817 | A1 * | 2/2008 | Ribordy | 72/347 |

FOREIGN PATENT DOCUMENTS

| | | | |
|---|---|---|---|
| DE | 24 19 389 | A1 | 11/1975 |
| DE | 199 43 441 | A1 | 3/2001 |
| JP | 2007 118017 | A | 5/2007 |

* cited by examiner

*Primary Examiner* — Peter DungBa Vo
*Assistant Examiner* — Joshua D Anderson
(74) *Attorney, Agent, or Firm* — Emch, Schaffer, Schaub & Porcello, Co., L.P.A.

(57) ABSTRACT

The invention relates to a drawing press (10) having a first ram (17) and a second ram (18). The first ram (17) is moved in a working direction (A) by an electromotive first ram drive (25) and the second ram (18) by an electromotive second ram drive. The drawing press (10) also has a coupling means (35) which can be switched between an uncoupling state and a coupling state. In the uncoupling state, the two rams (17), (18) can move independently of one another in the working direction (A). In the coupling state, the coupling means (35) ensures that a relative movement between the two rams (17, 18) is prevented. The drawing press (10) can therefore be operated as a single-acting or double -acting press.

13 Claims, 4 Drawing Sheets

DRAWING PRESS HAVING TWO COUPLABLE RAMS

CROSS REFERENCE TO RELATED APPLICATION

Figure 1:
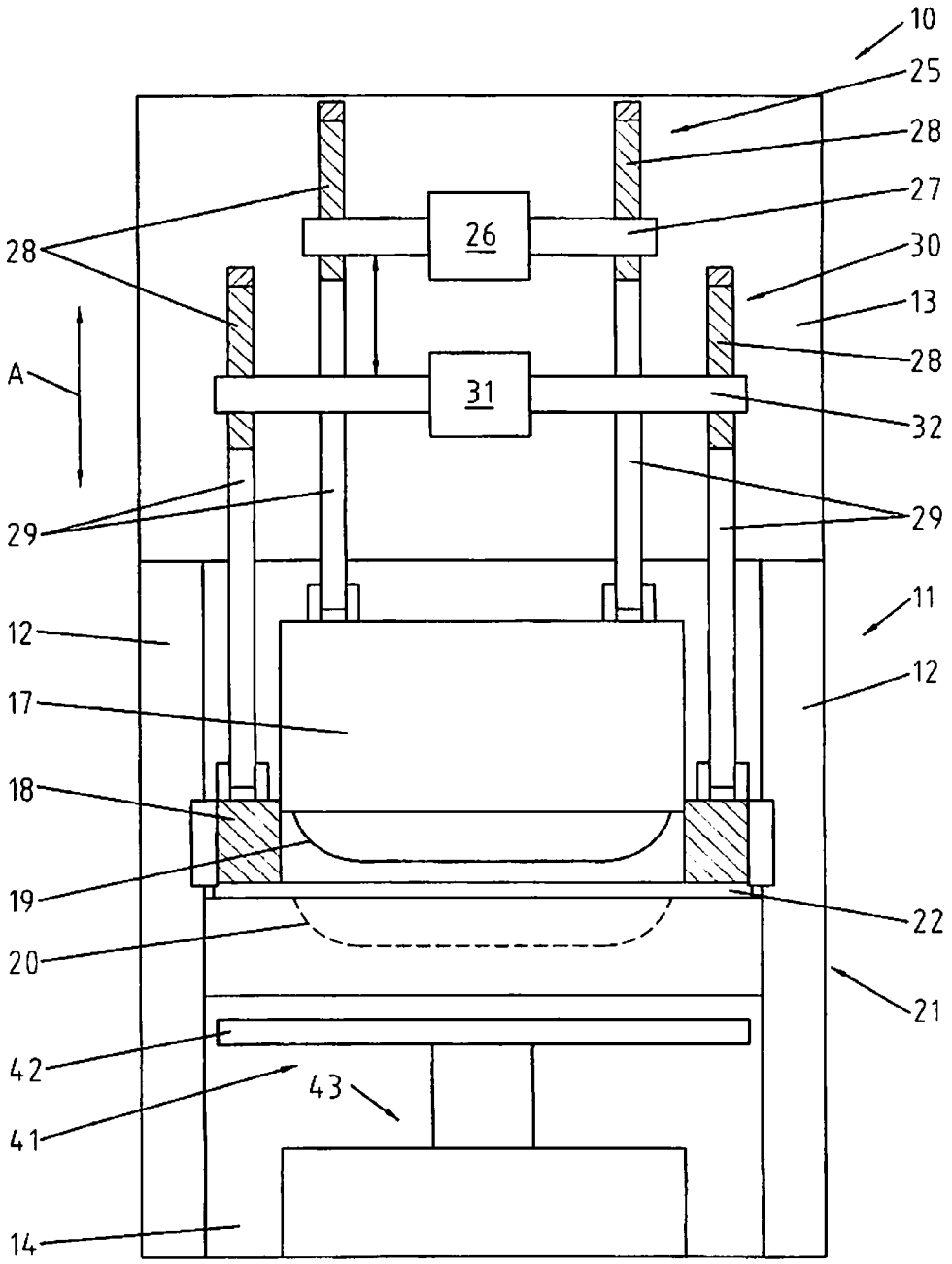

The present patent application is based upon and claims the benefit of German patent application no. 102011 001 314.8 filed Mar. 16, 2011 and PCT application no. PCT/EP2012/054716, filed Mar. 16, 2012.

BACKGROUND OF THE INVENTION

The invention relates to a drawing press, which serves to produce molded sheet metal parts, such as auto body parts, for example.

Double-acting presses are known for deep-drawing sheet metal parts. In the case of such presses, a sheet metal holding ring is arranged so as to be capable of being moved relative to a drawing punch. The sheet metal holding ring bears on the circuit board, which is to be deformed, and exerts a holding force of clamping force, while the drawing punch subsequently deforms the circuit board in cooperation with a mold. Such a press is known from DE 24 19 389, for example. Provision is made therein for a hydraulic drawing press, in the case of which a drawing punch as well as a sheet metal holding ring 12 are provided on a ram, which can be moved in working direction. In response to the downwards movement of the ram, the sheet metal holding ring thus initially impacts the circuit board and a deformation of the circuit board by means of the drawing punch takes place only in response to a continued downwards movement.

A double-acting molding machine comprising an inner ram and an outer ram is further known from DE 199 43 441 A1. An eccentric drive encompasses an eccentric shaft, which is connected to the outer ram via connecting rods. A toggle joint drive having two joint levers connects the inner ram to the eccentric shaft via a further lever.

SUMMARY OF THE INVENTION

Based on the known presses, it can be considered to be a task of the instant invention to design the possible applications of the press to be more flexible and to ensure a high quality of the produced molded parts.

For this purpose, the drawing press encompasses a first ram, which can be driven in a working direction by means of a first ram drive. The drawing press furthermore has a second ram, which can be driven by means of a second ram drive. The two ram drives in each case encompass an electric motor. Both ram drives can be activated independent from one another, so that the movements of the first ram and of the second ram relative to the lower die or to the circuit board, respectively, can be carried out and provided independently. A control unit serves to drive the ram drives. The drawing press furthermore encompasses a coupling means, which can be switched between a coupling state and an uncoupling state. In the coupling state, a kinematic coupling is established between the two rams, which prevents a relative movement of the first ram relative to the second ram. Preferably, the coupling means is a mechanical coupling means, which establishes a direct mechanical connection between the two rams in the case of one exemplary embodiment, and which effects a kinematic coupling of the two ram drives in the case of another exemplary embodiment. The drawing press can therefore be switched between a single-acting mode of operation in the coupling state and a double-acting mode of operation in the uncoupling state via the coupling means.

In the uncoupling state, the second ram can be used as a holding-down device, for example. Its position, its movement speed and/or its clamping force, with which it holds the circuit board, can be provided freely and independent from the position and/or the speed, at which the first ram moves, which can serve as drawing punch, for example. The sheet metal holding force, which is exerted by the second ram in the case of this mode of operation and its course during the drawing process are significant for the quality of the produced molded part. Due to the independence of the two ram movements, the sheet metal holding force, which the second ram exerts on the circuit board, can be adapted to the requirements of the drawing process, such as, e.g., the material and the thickness of the circuit board. In addition, it is possible to adjust this sheet metal holding force completely independently from the current position of the drawing punch, which is formed by the first ram. The sheet metal holding force can be adjusted to the speed of the first drawing punch, for example, in this manner. Independent on the movement control of the first drawing punch, the possibility further arises to provide a switching between a position-controlled or position-regulated and a force-controlled or force-regulated control of the second ram drive via the control unit.

In the event that the coupling state is established via the coupling means, the two rams move together in working direction. It is thus possible to press the two rams against the circuit board using a high molding force. The forces, which are provided by the first ram drive and by the second ram drive in working direction, can be added to form a high total force in the coupling state. As a function of the processing task, it can also be sufficient in the coupling state, if only one of the ram drives is moved. In the coupling state, the two rams preferably form a common enlarged clamping surface. In the coupling state, the drawing press interacts as a single-acting press with a drawing tool, which is attached to the press frame in this operating mode.

It is advantageous, if the two ram drives are kinematically identical. They can be embodied as eccentric drives or joint drives, for example. Due to the identical embodiment of the two ram drives, it is attained that the same control of both ram drives can take place very simply in the case of the coupling by means of the control unit, when the drawing force, which is required for the drawing process, is larger than the force, which can be exerted by an individual ram drive. A complex control with different parameters for each ram drive is avoided in this case.

The coupling means can establish a kinematic connection between the two ram drives, for example. In this case, said coupling means can be embodied as switchable shaft coupling or as intermediate drive between the two ram drives. The coupling means is controlled in particular by means of the control unit, so as to switch between the coupling state and the uncoupling state. The operating state of the drawing press can be changed particularly quickly and easily in this manner.

The electric motors of the ram drives can be embodied as servomotors or as torquemotors. They make it possible to accurately adjust the position and/or force of the rams in working direction. In a manner of speaking, the ram drives are "dry" and do not require any hydraulic liquid. In the case of the preferred exemplary embodiment of the drawing press, the two ram drives are embodied as top drives and are therefore arranged above the two rams on the press frame. The lower die, which is located opposite the rams in working direction, can be embodied so as to be completely free of drives.

Advantageous embodiments of the drawing press according to the invention follow from the dependent patent claims as well as from the description. The description is limited to significant features of the invention. The drawing should be used as a supplement.

Other objects and advantages of the present invention will become apparent to those skilled in the art upon a review of the following detailed description of the preferred embodiments and the accompanying drawings.

IN THE DRAWINGS

Figure 2:
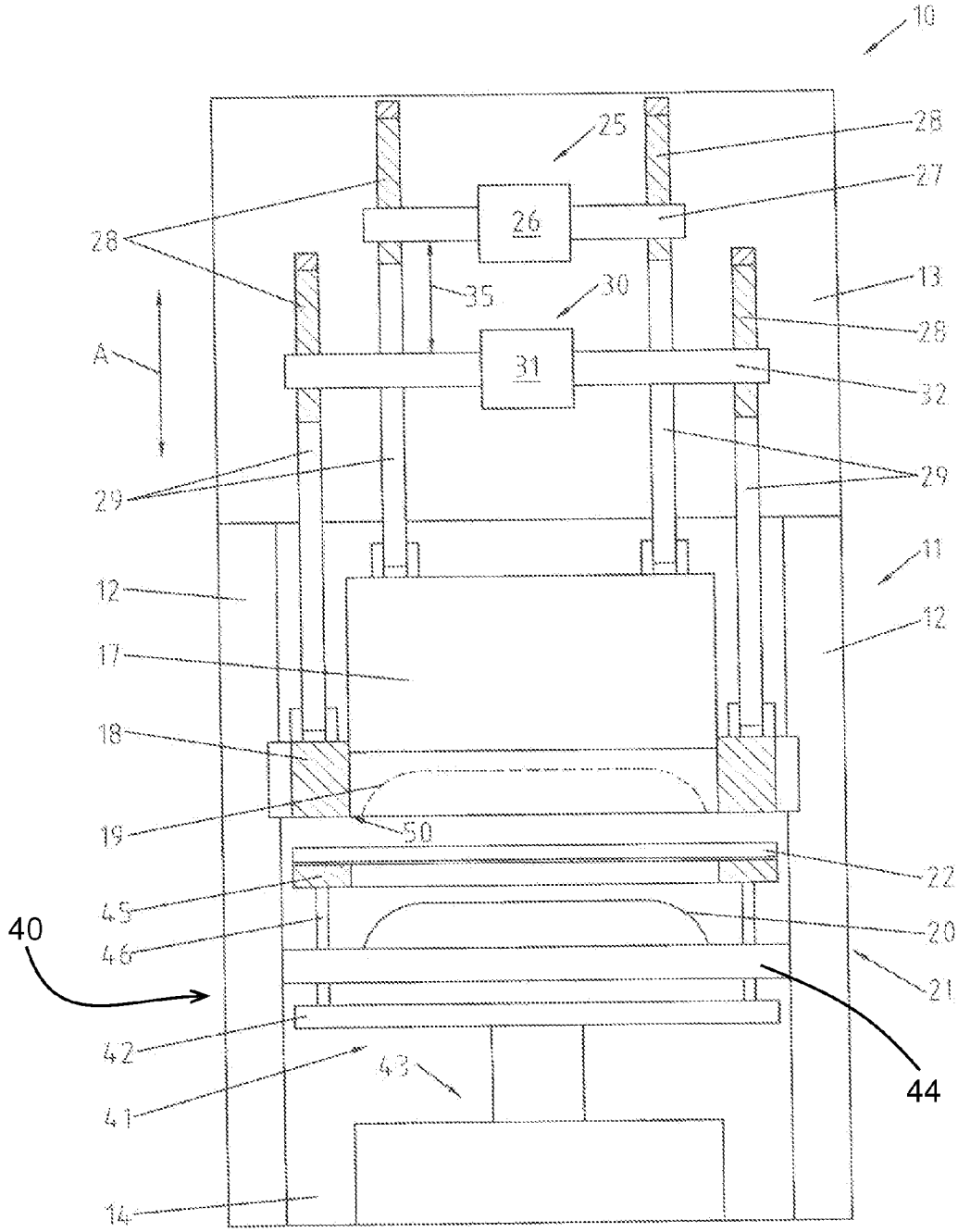
Figure 3:
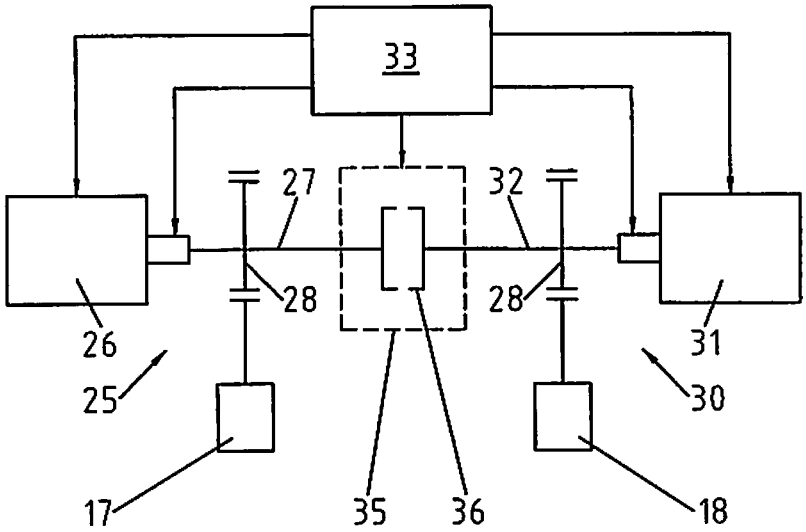
Figure 4:
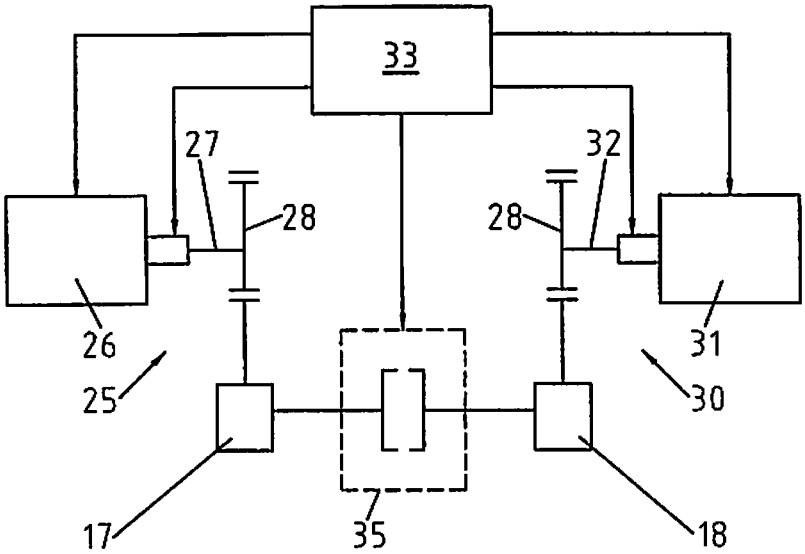
Figure 5:
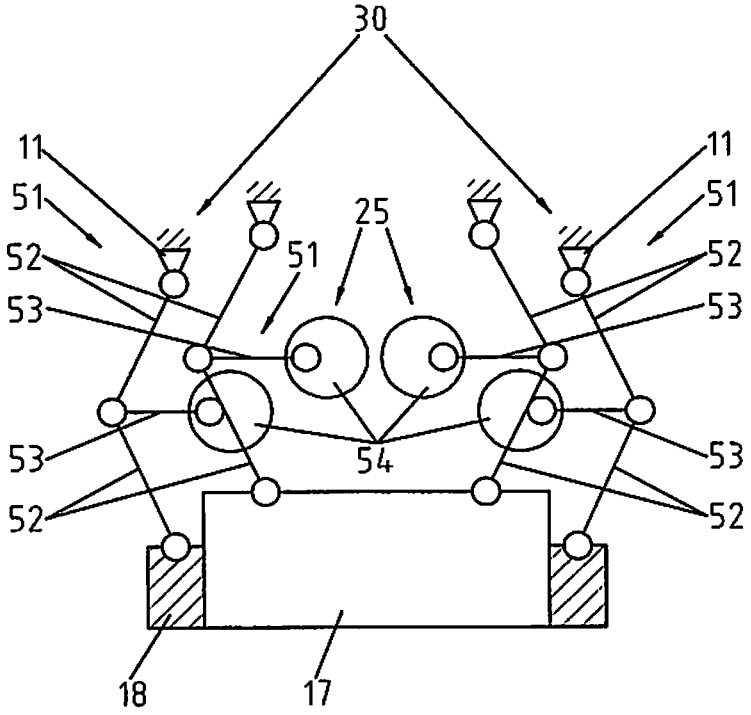

FIG. 1 shows a schematic, block diagram-like side view of an exemplary embodiment of a drawing press in the uncoupling state, FIG. 2 shows the exemplary embodiment of the drawing press according to FIG. 1 in the same view in the coupling state, FIG. 3 shows a block diagram of an exemplary embodiment of a coupling means for coupling the ram movement, FIG. 4 shows a block diagram of another exemplary embodiment of a coupling means for coupling the ram movement and FIG. 5 shows a schematic block diagram-like illustration of the ram drives in an embodiment as joint drives.

DETAILED DESCRIPTION OF THE INVENTION

FIGS. 1 and 2 illustrate a drawing press 10, which encompasses a press frame 11, which encompasses a plurality of stands 12, which run substantially vertically and which support a head 13. The lower part of the press frame 11 includes a base 14, to which the supports 12 are connected. The base 14, the stands 12 and the head 13 form a closed, stiff frame.

A first ram 17 as well as a second ram 18 are arranged on the press frame 11 in a working direction A and so as to be movable substantially vertically, for example. In the exemplary embodiment described herein, the first ram 17 is embodied as an inner ram, which is surrounded by the second ram 18 in a ring-shaped manner. The two rams 17, 18 are arranged coaxially to one another. An upper tool element 19, for example. which cooperates with a lower tool element 20 of a bottom die 21, to mold a circuit board 22, is arranged on the first ram 17.

A first ram drive 25 is present for driving the first ram 17. The first ram drive 25 encompasses a first electric motor 26, for example a servomotor or a torquemotor, which drives a first eccentric shaft 27. At least one eccentric 28, and two eccentrics 28 for example, on which a connecting rod 29 is in each case rotatably supported, is arranged on the first eccentric shaft 27. On the opposite side of the eccentric 28, each connecting rod 29 is connected to the first ram 17 in an articulated manner. In response to a rotation of the eccentric shaft 27, the connecting rods 29 are displaced in working direction A, which can bring about the upwards and downwards movement of the first ram 17 in working direction A.

A second ram drive 30 having a second electric motor 31 serves to drive the second ram 18. The two ram drives are designed so as to be kinematically identical. The second electric motor 31 therefore drives a second eccentric shaft 32, on which at least one and for example two eccentrics 28 are arranged in a torque proof manner. Analogously to the first eccentric drive 25, two connecting rods 29, which are connected to the second ram 28 in an articulated manner, are rotatably supported on these eccentrics 28. The two ram drives 25, 30 are designed so as to be kinematically identical. They encompass the same electric motors 26, 31 and the same translations, so that the same movement of the respective assigned ram 17, 18 is effected in working direction A in response to the control of the ram drives 25, 30 with the same control variable. The connecting rods 29 of the ram drives 25, 30 have the same length. Substantially the same forces of the rams 17 or 18, respectively, also result in working direction A in the case of the same control variable of the two ram drives 25, 30.

The two ram drives 25, 30 are controlled by means of a control unit 33. The control unit 33 can adjust and provide the movement and/or position and/or force of each ram 17, 18 independently. The first ram 17 and/or the second ram 18 can be position-controlled or position-regulated or force-controlled or force-regulated, for example, in this manner. The corresponding control of the ram drive 25, 30 or of the respective electric motor 26, 31, respectively, takes place by means of the control unit 33.

A coupling means 35 will furthermore be switched between a coupling state and an uncoupling state via the control unit 33. In the uncoupling state, the two rams 17, 18 can move completely independent from one another in working direction A. In the coupling state, the coupling means 35 prevents a relative movement between the two rams 17, 18 in working direction A. In the latter case, the two rams 17, 18 move only together.

In the case of the exemplary embodiments described herein, the coupling means 35 establishes a mechanical and/or kinematic coupling between the two rams 17, 18. In the case of a first exemplary embodiment according to FIG. 3, the two ram drives 25, 30 are coupled kinematically for this purpose. In the coupling state, it is possible, for example, to connect the two eccentric shafts 27, 32 of the two ram drives 25, 30 to one another in a torque-proof manner by means of a shaft coupling 36. The shaft coupling 36 is embodied so as to be capable of being switched and separates the two eccentric shafts 27, 32 from one another in the uncoupling state. The shaft coupling 36 can be switched by means of the control unit 33. As an alternative to this preferred exemplary embodiment, it is also possible to embody the shaft coupling 36 or another coupling means 35 so as to be capable of being operated or switched, respectively, mechanically by means of an operator, so that a manual switch between the coupling state and the uncoupling state takes place.

FIG. 4 illustrates an alternative embodiment of the coupling means 35. A mechanical connection is established directly between the first ram 17 and the second ram 18 by means of the coupling means 35, when the latter is in the coupling state. In the uncoupling state, the coupling means 35 releases the relative movement between the two rams 17, 18. The mechanical connection in the coupling state can be attained, for example, by means of a non-positive and/or position connection between the two rams 17, 18, for example by means of locking means and/or clamping means. In the case of this embodiment, as is illustrated schematically in FIG. 4, the coupling means 35 can also be embodied so as to be capable of being switched by means of the control unit 33 or, in the alternative, as being capable of being switched manually.

The drawing press 10 can either be operated as double-acting press or a single-acting press as a function of the state of the coupling means 35. For the operation as a single-acting press, the lower die 21 encompasses a drawing device 40 (FIG. 2). According to the example, the drawing device 40 encompasses a table cushion 41 having a suspended intermediate plate 42, which can be positioned and/or moved in working direction A of the drawing press 10 via a table cushion drive 43. A plurality of pressure rods 46, which permeate a press table 44 and which encompass a ring-shaped sheet metal holder 45 on their end, which faces the upper tool element 19 or the rams 17, 18, respectively, are arranged on the intermediate suspended plate 42. The lower tool element 20 is arranged on the press table 44, below the sheet metal holder 45.

The upper tool element 19 and the lower tool element 20 are embodied so as to be complementary to one another. It is possible to embody the lower tool element 20 or the upper tool element 19 as a shape having a concave recess, as is shown in an exemplary manner in FIGS. 1 and 2.

The drawing press 10 operates as follows:

With reference to FIG. 1, the operation of the drawing press 10 is explained in the uncoupling state of the coupling means 35. Here, the drawing press operates as double-acting press. In this case, the second ram 18 serves as holding-down device. Prior to the molding process of the circuit board 22, the second ram 18 is initially moved downwards until it rests against the circuit board 22. The movement to the circuit board 22 in working direction A is carried out by means of the control or regulation of the position of the second ram 18. As soon as it has reached the circuit board 22, the control unit 33 switches to the control or regulation of the clamping force, which the second ram 18 exerts on the circuit board 22. It is held between the second ram 18 and a clamping surface, which is present on the lower die 21.

The control unit controls the second ram drive 30 independent from the first ram drive 25 such that it only reaches the circuit board 22 when the first ram 18 acts on the circuit board 22 with the desired clamping force. The actual drawing process of the circuit board 22 is carried out via the control or regulation of the position and/or of the speed of the first ram 17 in working direction A. For this purpose, the upper tool element 19 and the lower tool element 20 cooperate and bring the circuit board 22 into the desired shape. During this molding process, the clamping force, which the second ram 18 exerts onto the circuit bard 22, can vary. The clamping force can be adjusted so as to be adapted to the position and/or the speed of the first ram 17. Due to the independence of the two ram drives 25, 30 and due to the fact that the ram drives 25, 30 are embodied as electric drives, a corresponding control by the control unit 33 is possible very simply and accurately.

The drawing press 10 can also be operated as single-acting press, as it is illustrated in FIG. 2. In the case of this embodiment, the drawing device 40 is additionally attached to the lower die 21. In the mode of operation of the drawing press 10 as single-acting press, the sheet metal holding ring 45 and the pressure rods 46 are connected to the suspended intermediate plate 42. In the event that the mode of operation is to be adjusted as double-acting press, the pressure rods 46 and the sheet metal holding ring 35 can be removed easily. The mode of operation as a single-acting press is further adjusted in that the coupling means 35 is switched into its coupling state. The two rams 17, 18 are thereby movement-coupled. On its side, which faces the lower die 21, they form a common clamping surface 50. The moments of the two electric motors 26, 31 of the two ram drives 25, 30 can be added in this state, so that the force, with which the two rams 17, 18 can be moved together against the circuit board 22, can be larger than the force, which can be exerted solely by the first or by the second ram drive 25, 30. Molding processes, which require a large force of the ram 17, 18 in working direction A and which cannot be created in the mode of operation of double-acting press, can thus also be carried out by means of the drawing press 10. Due to the coupling of the two rams 17, 18, they simultaneously move in working direction A and simultaneously impact the circuit board 22, which bears on the sheet metal holder 45. The two rams 17, 18 move the circuit board 22, together with the sheet metal holder 45, the pressure rods 46 and the suspended intermediate plate 42 in working direction A against the force of the sheet metal holder, which is applied via the table cushion drive 43, wherein the upper tool element 19 and the lower tool element 20 cooperate and a molding of the circuit board 22 takes place.

In the case of the exemplary embodiments described herein, the two ram drives 25, 30 are embodied as top drives. According to the embodiment according to FIGS. 1 and 2, the ram drives 25, 30 are formed by means of eccentric drives. As a modification to the illustrated embodiment, each ram drive 25, 30 can also encompass more than one electric motor 26, 31.

Instead of the eccentric drives 25, 30, a joint drive 51 can also be used as ram drive. A joint drive 51 encompasses two levers 52, which are connected to one another in an articulated manner, wherein the one lever 52 is connected in an articulated manner to the assigned ram 17 or 18, respectively, and the respective other lever 52 is connected in an articulated manner to the press frame 11. A drive lever 53, which is driven by means of an eccentric 54, is located at the joint connection between the two levers 52.

The invention relates to a drawing press 10 having a first ram 17 and a second ram 18. The first ram 17 is moved by means of an electromotive first ram drive 25 and the second ram 18 is moved by means of an electromotive second ram drive in a working direction A. The drawing press 10 further encompasses a coupling means 35, which can be switched between an uncoupling state and a coupling state. In the uncoupling state, the two rams 17, 18 can move independent from one another in working direction A. In the coupling state, the coupling means 35 ensures that a relative movement is prevented between the two rams 17, 18. The drawing press 10 can thus be operated as a single-acting or double-acting press.

LIST OF REFERENCE NUMERALS

10 drawing press
11 press frame
12 stand
13 head
14 base
17 first ram
18 second ram
19 upper tool element
20 lower tool element
21 lower die
22 circuit board
25 first ram drive
26 first electric motor
27 first eccentric shaft
28 eccentric
29 connecting rod
30 second ram drive
31 second electric motor
32 second eccentric shaft
35 coupling means
36 shaft coupling
40 drawing device
42 table cushion
42 suspended intermediate plate
43 table cushion drive
44 press table
45 sheet metal holder
46 pressure rod

50 clamping surface
51 joint drive
52 lever
53 drive lever
54 eccentric
A working direction The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A deep-drawing press (10) comprising, a first ram (17), which is supported in a press frame (11) so as to be capable of being moved in a working direction (A) by means of a first ram drive (25), a second ram (18), which is supported in a press frame (11) so as to be capable of being moved in a working direction (A) by means of a second ram drive (30), wherein the two ram drives (25, 30) in each case encompass electric motors (26, 31) and can be driven independent from one another, a control unit (33) for controlling the two ram drives (25, 30) which can switch a coupling means for coupling the first and second rams between an uncoupling state and a coupling state, said coupling means (35), allowing independent movements of the first and second rams in the uncoupling state, and preventing a relative movement of the first and second rams (17, 18), in the coupling state; wherein the second ram is used as a holding down device and the first ram is used as a drawing punch in the uncoupling state.

2. The drawing press according to claim 1, characterized in that the two ram drives (25, 30) are kinematically identical.

3. The drawing press according to claim 1, characterized in that the two ram drives (25, 30) are embodied as eccentric drives (28, 39) or joint drives (51).

4. The drawing press according to claim 1, characterized in that the rams (17, 18) move together in the working direction (A) in the coupling state and cooperate with a drawing device (40).

5. The drawing press according to claim 1, characterized in that, in the coupling state, the coupling means (35) establishes a mechanical connection directly between the first ram (17) and the second ram (18).

6. The drawing press according to claim 1, characterized in that, in the coupling state, the coupling means (35) establishes a kinematic connection between the first ram drive (25) and the second ram drive (30).

7. The drawing press according to claim 1, characterized in that, in the coupling state, a drive force caused by first and second rams drive (25, 30), acts on both rams (17, 18).

8. The drawing press according to claim 1, characterized in that, in the coupling state, only one or both of the first and second ram drives (25, 30) are operated as a function of a required press force.

9. The drawing press according to claim 1, characterized in that, in the coupling state, the two rams (17, 18) form a common clamping surface (50).

10. The drawing press according to claim 1, characterized in that the second ram (18) surrounds the first ram (17) in a ring-shaped manner.

11. The drawing press according to claim 1, characterized in that the two ram drives (25, 30) are embodied as top drives.

12. The drawing press according to claim 1, characterized in that the control unit (33) is equipped to control the second ram drive (30) either for controlling the position or for controlling the force of the second ram (17).

13. The drawing press according to claim 12, characterized in that the control unit (33) is equipped to control the second ram drive (30) as a function of the speed and/or the position of the first ram (17).

* * * * *